US005650066A

United States Patent [19]

Blandin et al.

[11] Patent Number: 5,650,066

[45] Date of Patent: Jul. 22, 1997

[54] GRATING MODULE FOR PERIPHERAL GUTTER FOR DISCHARGING OVERFLOW WATER FROM A SWIMMING POOL

[75] Inventors: Jean-Claude Blandin; Daniel Pichon, both of Cholet, France

[73] Assignee: Societe ETEX, Paris, France

[21] Appl. No.: 602,719

[22] PCT Filed: Jan. 23, 1995

[86] PCT No.: PCT/FR95/00072

§ 371 Date: May 31, 1996

§ 102(e) Date: May 31, 1996

[87] PCT Pub. No.: WO95/20085

PCT Pub. Date: Jul. 27, 1995

[30] Foreign Application Priority Data

Jan. 25, 1994 [FR] France ..... 94 00739

[51] Int. Cl.[6] ..... E04H 4/12; E04C 2/42

[52] U.S. Cl. ..... 210/169; 210/232; 4/510

[58] Field of Search ..... 210/169, 232, 210/456; 4/510

[56] References Cited

U.S. PATENT DOCUMENTS

| | | | |
|---|---|---|---|
| 3,537,111 | 11/1970 | Whitten, Jr. | 210/169 |
| 3,916,458 | 11/1975 | Ogden | 210/169 |
| 3,972,077 | 8/1976 | Whitten, Jr. | 4/510 |
| 3,990,167 | 11/1976 | Whitten, Jr. | 4/510 |
| 4,059,856 | 11/1977 | Patterson | 210/169 |
| 4,206,522 | 6/1980 | Baker | 210/169 |
| 4,483,025 | 11/1984 | Meredith | 4/510 |
| 4,593,421 | 6/1986 | Cohen | 210/169 |
| 4,706,309 | 11/1987 | van den Broek | 210/169 |

FOREIGN PATENT DOCUMENTS

| | | |
|---|---|---|
| 0 526 304 | 2/1993 | France . |
| 26 02 114 | 8/1977 | Germany . |
| 26 07 051 | 8/1977 | Germany . |

*Primary Examiner*—Neil McCarthy
*Assistant Examiner*—Theodore M. Green
*Attorney, Agent, or Firm*—Pollock, Vande Sande & Priddy

[57] ABSTRACT

Grating module for peripheral gutter for discharging overflow water from a swimming pool, which comprises a bendable, central longitudinal rib acting as a link for at least one transverse central rib arranged as a ridge on either side of this central rib, the said transverse rib being provided on its upper part with perpendicular slats projecting outwards and constituting the plantar span of the grating.

11 Claims, 3 Drawing Sheets

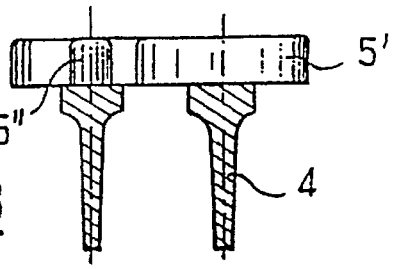
FIG_3
FIG_4
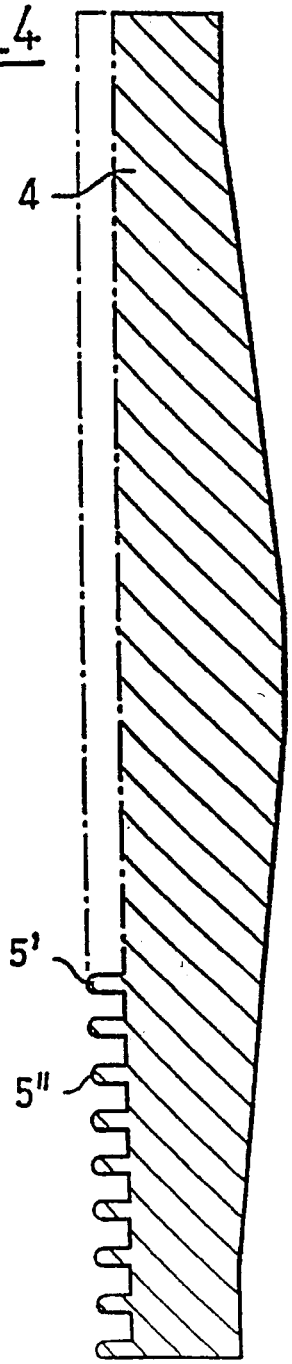
FIG_2
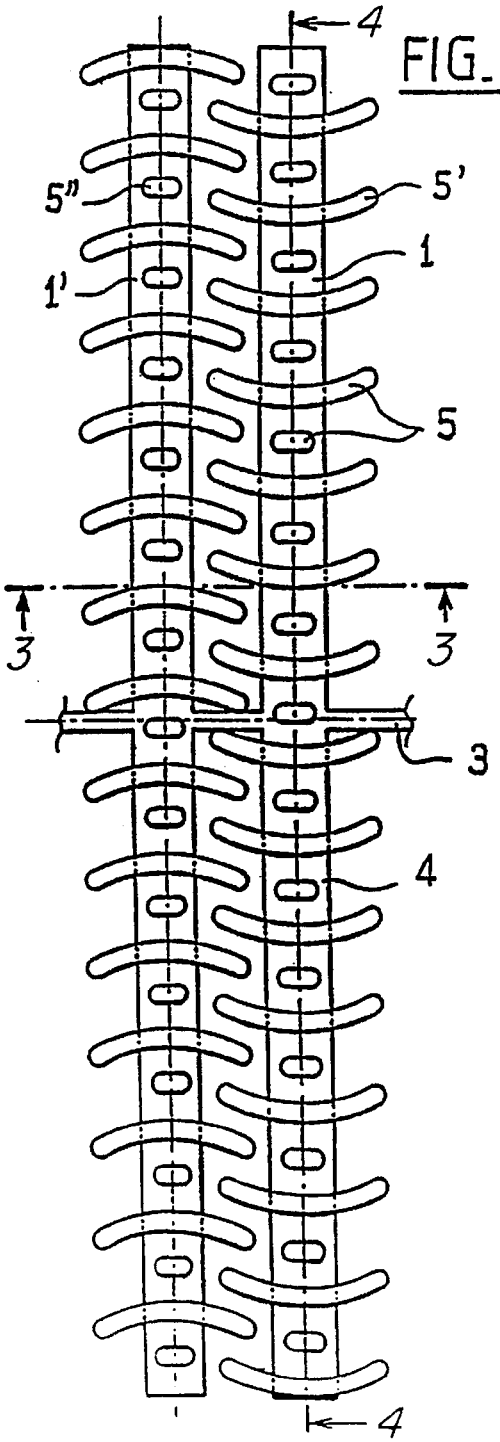

GRATING MODULE FOR PERIPHERAL GUTTER FOR DISCHARGING OVERFLOW WATER FROM A SWIMMING POOL

FIELD OF THE INVENTION

The invention relates on the one hand to a grating module for peripheral gutter for discharging overflow water from a swimming pool, the said gutter adjoining the border of the swimming pool and on the other hand to the grating obtained from these modules.

BACKGROUND OF THE INVENTION

It is known to use, around the periphery of swimming pools, channels covered with gratings made of metal, concrete, polymer concrete or plastics and which convey the accidental overflow water so as to reincorporate it into the swimming pool water treatment cycle.

These channels and their grating are as a general rule of rectangular shape, this moreover corresponding perfectly with the requirements of most swimming pools whose edges are generally straight.

By contrast, when it becomes a question of following the curved edges of swimming pools, the construction of a peripheral gutter then requires the deployment of special gratings whose radius of curvature corresponds perfectly with that of the gutter.

It would be possible to envisage making swimming pool gratings employing the configuration of the gratings described in EP-A-0,526,304 and bending them, but this solution presents a number of problems both as regards the reliability of the gutter and the comfort of the user.

Indeed, when bending the grating about its longitudinal axis, there is a narrowing of the spaces between the ridges situated on the inside of the bent axis, but as a corollary there is an equivalent widening of the spaces between the ridges situated on the outside of the bent axis. These enlarged spaces constitute, through their conical configuration, a meager bearing surface for the foot of the user, and therefore uncomfortable, and allow various objects and litter to penetrate easily into the gutter.

According to another characteristic of the gratings of the prior art, the water penetration orifices are generally located perpendicularly to the longitudinal axis of the gutter and with no asperity other than those necessary to make the upper surface of the grating non-slip. During large overflows, the water from the swimming pool therefore tends to pass over the grating and to spread out beyond the gutter, in time causing a sizable loss of water from the swimming pool which has to be made up periodically.

BRIEF DESCRIPTION OF THE INVENTION

The invention aims to reedy these various drawbacks by proposing a grating module for a peripheral gutter for discharging overflow water from a swimming pool. This grating module is characterized in that it comprises a bendable, central longitudinal rib acting as a link for at least one transverse rib arranged as a ridge on either side of this central rib, the said transverse rib being furnished on its upper part with perpendicular slats projecting outwards and constituting the plantar span of the grating.

The design of this bendable grating made from a semi-rigid thermoplastic material enables it to adapt both to straight lines and curvatures imposed by the peripheral gutter of a swimming pool or by any similar type of gutter irrespective of the usage thereof.

Indeed, by virtue of the combination of a set of successively long and short slats located on the upper part of the transverse ribs and of the back-to-back deployment of the transverse ribs of two adjacent modules, it follows that, when bending the grating, there is a possible interweaving of the said slats through a comb effect. Thus, in the inner part of the bend (with respect to the central rib), the long slats of a module lie systematically opposite the short slats of the adjacent module and can therefore overlap each other.

On the other hand, in the outer part of the bend (with respect to the central rib), the particular shape of the long slats makes it possible to effect the interweaving of the said long slats and to retain a regular plantar span. The grating therefore remains comfortable for the user and precludes any accidental intrusion of bulky objects into the gutter.

According to another subject of the invention, the slats located on the upper part of each transverse rib form a projection with respect to these ribs and constitute a wave break and a trap arranged substantially perpendicularly to the overflow water from the swimming pool. The covering of the grating is therefore perfectly nonslip since the water cannot stagnate on its upper part.

According to yet another subject of the invention, at each end of the longitudinal rib each grating module possesses a link device making it possible to fasten together the courseway constituted by several grating modules.

Lastly, it should be noted that the module of the grating can comprise, on either side of the central longitudinal rib, one or more transverse ribs, the grating obtained then being built up by assembling one or more of these modules such as defined previously.

BRIEF DESCRIPTION OF THE DRAWINGS

Other characteristics, advantages and means of deploying the invention will emerge further from the description which follows given with reference to the appended drawings in which:

FIG. 2 is a detail of FIG. 1, in plan view.

FIG. 3 is a vertical section through B—B.

FIG. 4 is a vertical section through A—A.

DETAILED DESCRIPTION OF THE INVENTION

Figure 1:
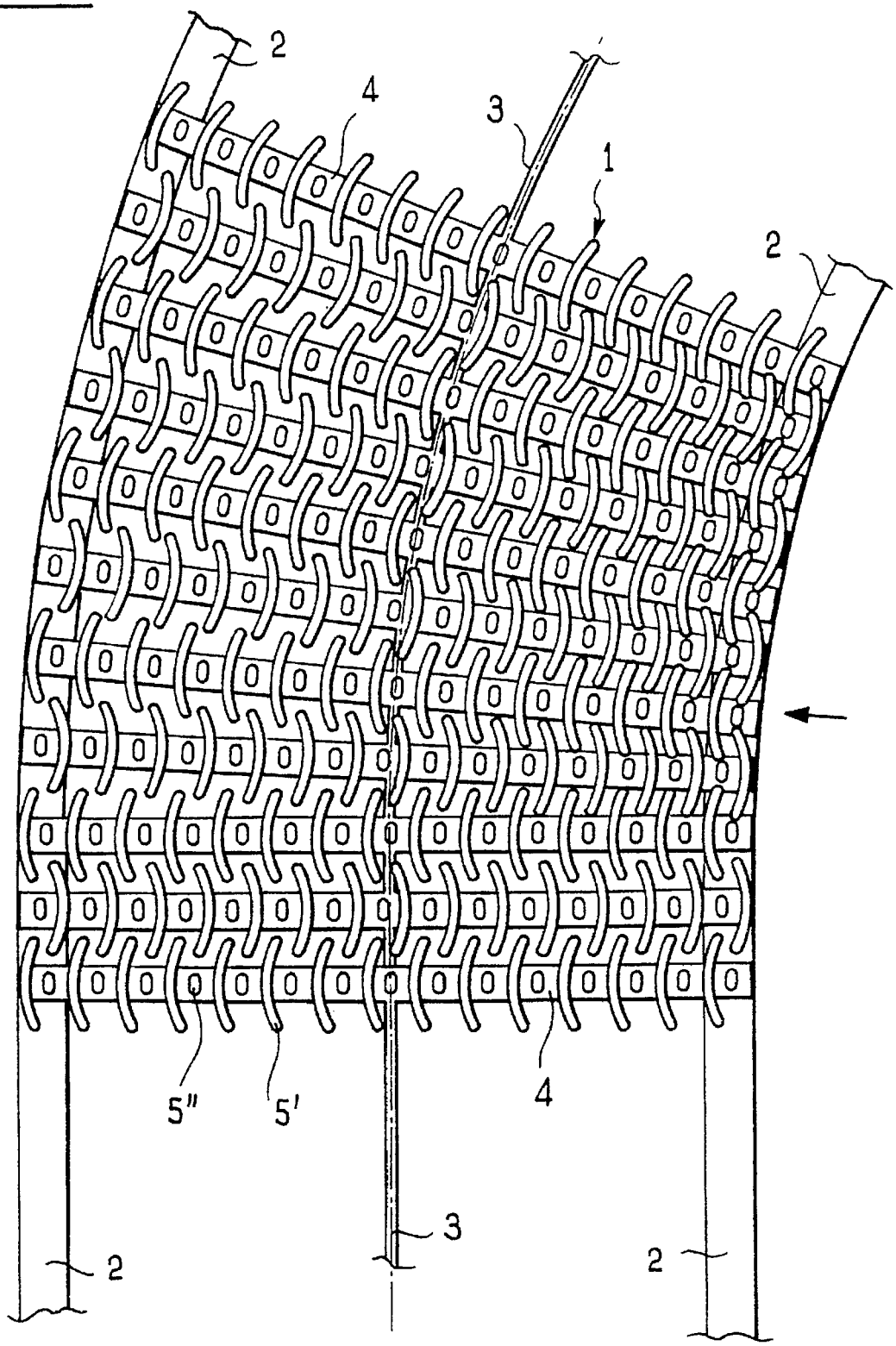
FIG. 1 is a plan view showing the principle of operation of a grating according to the invention, deployed in a bent gutter.

As represented diagrammatically in FIGS. 1 or 2 a grating module (1) according to the invention has been made from an injected semi-rigid synthetic material deployed on a gutter (2) located along the border (not represented) of a swimming pool.

The grating module (1) comprises a central longitudinal rib (3) offering sufficient elasticity to follow the curvatures of the gutter (2). This central rib acts as a link between the various transverse ribs (4) arranged as ridges on either side thereof.

In FIGS. 1 or 2 it is observed that on their upper part the transverse ribs (4) are furnished with slats (5). These slats project perpendicularly outwards therefrom.

The set of slats (5) is composed in succession of long slats (5') and short slats (5"). These long slats (5') form an angle with respect to the longitudinal axis of the transverse ribs (4)

and may have a configuration of the "V", "W", "A", "U" type or, as in the present example, of an arc of a circle. These short slats (5") are studs or bosses whose base does not exceed the width of the transverse rib (4).

The transverse ribs of two adjacent modules, as represented in FIG. 2, are arranged or deployed back-to-back on the central longitudinal rib (3), a long slat (5') of a module (1) lying opposite a short slat (5") of a module (1').

This combination of the shape of the slats (5) and the alternation of the long (5') and short (5") slats between the adjacent transverse ribs, allied with the elasticity of the central longitudinal rib, allows the bending of the grating module (1), as represented in FIG. 1, up to a minimum inside radius of 335 mm in the present example.

FIGS. 3 and 4 represent respectively transverse and longitudinal sections through the transverse ribs (4). These figures illustrate the shape of the lower part of these ribs and the reinforcements provided to support any load or any impact applied from top to bottom.

It will be observed more particularly in FIG. 4 that, on the upper part of these ribs (4), the vertical slats (5'—5") all have the same height of projection with respect to the upper part of the said transverse ribs. These projections are composed of the long (5') and short (5") slats and serve as plantar span for the user of the swimming pool. As indicated previously, when bending the grating module (1), care should be taken that the end slats (5'), outside the bending region, remain overlapped. In this way, excessively large gaps will be avoided between the slats of two adjacent grating modules (1—1'), which gaps give rise to discomfort as regards the user and may allow obstructing objects to penetrate into the gutter.

It is also observed in FIGS. 1, 3 and 4 that the slats (5) projecting with respect to the upper part of each transverse rib (4) constitute a wave break and a trap with a substantially perpendicular configuration for the overflow water from the swimming pool (the arrow in FIG. 1 indicates the direction of arrival of this water). This water is therefore captured directly in the direction of the gutter (2) and cannot stagnate on the upper covering of the grating which remains dry and therefore nonslip.

Figure 5:
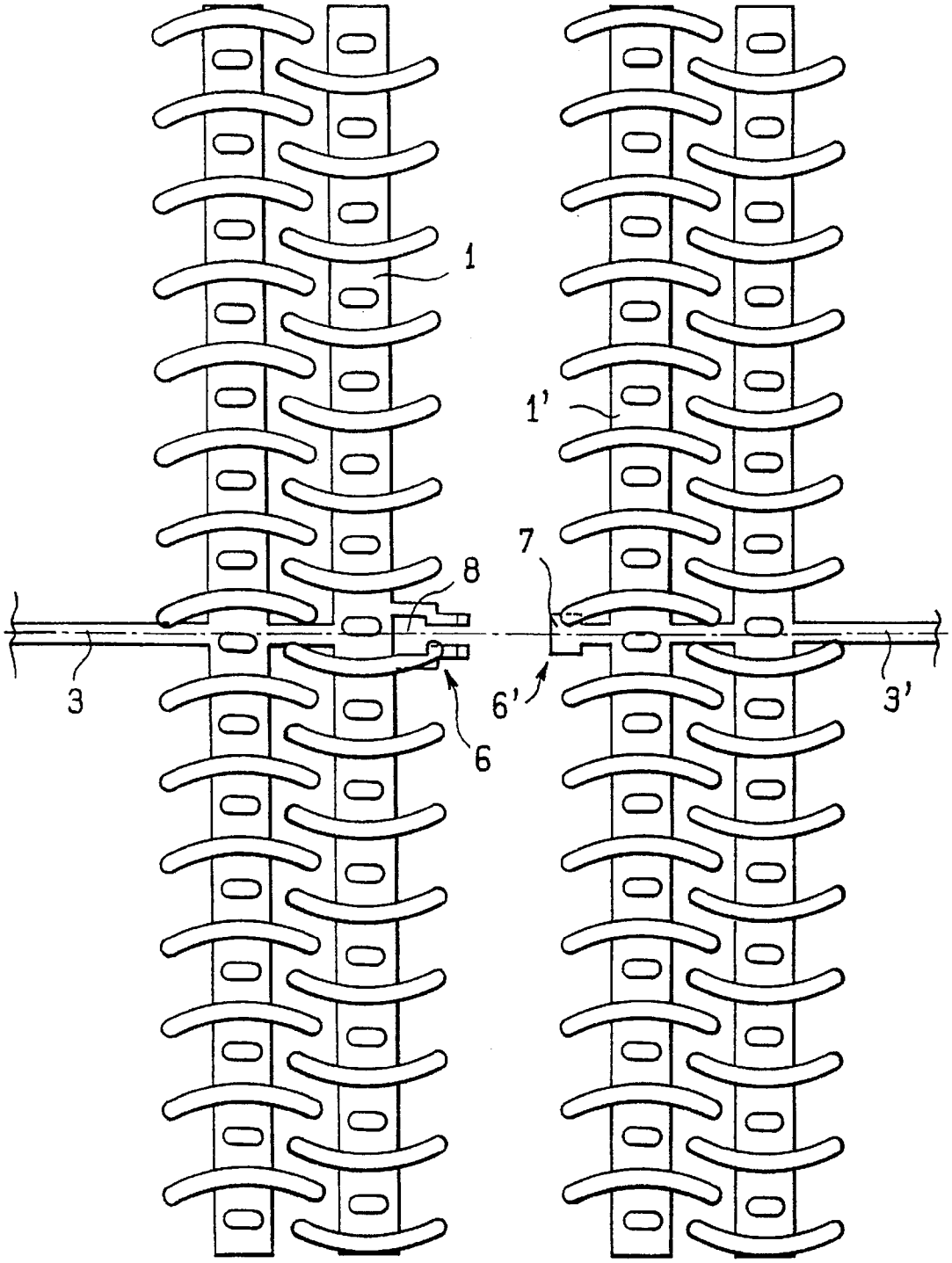
FIG. 5 represents a plan view of a grating module fitted with its devices for linking the adjacent modules.

As represented in FIG. 5, a grating pattern (1) according to the invention comprises, at each end of the central longitudinal rib (3), a link device (6—6') making it possible to fasten together the courseway constituted by several grating modules (1—1').

In the present example, this link device consists of a tenon (7) and a mortice (8); it follows that at each end opposite to its central longitudinal rib (3—3'), each grating module (1—1') comprises a tenon (7) and a mortice (8), which are intended to interlock with the corresponding mortice or tenon of the adjacent grating module.

Naturally, this mode of linking is merely indicative and it would be possible, without departing from the scope of the invention, to substitute any other linking means affording the same result.

In the same spirit, the grating for a swimming pool according to the invention could be constituted by one or more grating modules, each module comprising a bendable central longitudinal rib and at least one transverse rib furnished with slats.

We claim:

1. Grating module for peripheral gutter for discharging overflow water from a swimming pool, which comprises a bendable, central longitudinal rib acting as a link for at least one transverse central rib arranged on either side of this central rib, the said transverse rib being provided on its upper part with perpendicular slats projecting outwards and constituting a plantar span of the grating.

2. Grating module according to claim 1, wherein the central longitudinal rib is made from a semi-rigid thermoplastic material having a degree of elasticity.

3. Grating module according to claim 1 or 2, wherein said slats, successively long and short, are located on the upper part of the transverse rib.

4. Grating module according to claim 1, wherein said short slats are made in the form of studs or bosses whose base does not exceed the width of the transverse rib.

5. Grating module according to claim 4, wherein said long slats form an angle with respect to the longitudinal axis of the transverse rib.

6. Grating module according to claim 5, wherein said long and short slats all have the same height of projection with respect to the upper part of the transverse rib.

7. Grating module according to claim 6, wherein said slats project with respect to the upper part of the transverse rib and are arranged in a direction substantially perpendicular to the overflow water from the swimming pool.

8. Grating module according to claim 7, wherein at each end of the longitudinal rib it possesses a link device making it possible to fasten together the courseway constituted by several grating modules.

9. Grating modules according to claim 8, wherein said link device is composed of a tenon and a mortice.

10. Grating module according to claim 1, wherein said transverse ribs of two adjacent modules are deployed back-to-back on the central rib.

11. Grating for peripheral gutter for discharging the overflow water from a swimming pool, which is constituted by assembling at least two grating modules according to claim 1.

* * * * *